US009409736B2

(12) United States Patent
Iijima et al.

(10) Patent No.: US 9,409,736 B2
(45) Date of Patent: Aug. 9, 2016

(54) SHEET CONVEYING DEVICE AND IMAGE RECORDING APPARATUS

(71) Applicant: BROTHER KOGYO KABUSHIKI KAISHA, Nagoya-shi, Aichi-ken (JP)

(72) Inventors: Shota Iijima, Nagoya (JP); Masao Mimoto, Nagoya (JP); Takashi Omura, Inazawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/861,564

(22) Filed: Sep. 22, 2015

(65) Prior Publication Data

US 2016/0090254 A1 Mar. 31, 2016

(30) Foreign Application Priority Data

Sep. 25, 2014 (JP) ..... 2014-194541

(51) Int. Cl.

| | |
|---|---|
| ***B65H 85/00*** | (2006.01) |
| ***B65H 29/58*** | (2006.01) |
| ***B65H 5/36*** | (2006.01) |
| ***B65H 29/52*** | (2006.01) |
| ***B65H 7/20*** | (2006.01) |
| ***B65H 5/06*** | (2006.01) |
| ***B65H 5/26*** | (2006.01) |
| ***B65H 29/70*** | (2006.01) |

(52) U.S. Cl.

CPC ..... *B65H 5/36* (2013.01); *B65H 5/062* (2013.01); *B65H 5/068* (2013.01); *B65H 5/26* (2013.01); *B65H 7/20* (2013.01); *B65H 29/52* (2013.01); *B65H 29/58* (2013.01); *B65H 29/70* (2013.01); *B65H 85/00* (2013.01); *B65H 2404/14* (2013.01)

(58) Field of Classification Search

CPC ..... B65H 85/00; B65H 29/58; B65H 5/36; B65H 5/38

See application file for complete search history.

(56) References Cited

U.S. PATENT DOCUMENTS 8,567,941 B2 * 10/2013 Sano ..... B41J 3/4071 347/101
8,851,661 B2 * 10/2014 Iijima ..... H04N 1/00578 347/104

FOREIGN PATENT DOCUMENTS

JP 2013-75764 A 4/2013

* cited by examiner

*Primary Examiner* — Luis A Gonzalez
(74) *Attorney, Agent, or Firm* — Merchant & Gould P.C.

(57) ABSTRACT

A sheet conveying device includes a flap pivoting between a first state to contact a first path-defining member and a second state to be separated from a first path-defining member. The first path-defining member, which faces a second path-defining member in a facing direction, includes a guide surface for guiding a sheet conveyed along a first conveying path, a contact surface positioned farther from the second path-defining member in the facing direction than the guide surface and configured to contact the flap in the first state, and an inclined surface positioned downstream of the contact surface in a conveying direction and inclined such that an upstream end thereof in the conveying direction is closer to the second path-defining member in the facing direction than a downstream end thereof. The upstream end of the inclined surface is closer to the second path-defining member in the facing direction than the contact surface.

18 Claims, 10 Drawing Sheets

SHEET CONVEYING DEVICE AND IMAGE RECORDING APPARATUS

CROSS-REFERENCE TO RELATED APPLICATION

This application claims priority from Japanese Patent Application No. 2014-194541 filed on Sep. 25, 2014, the content of which is incorporated herein by reference in its entirety.

FIELD OF DISCLOSURE

The disclosure relates to a sheet conveying device configured to convey a sheet and an image recording apparatus including the sheet conveying device.

BACKGROUND

A known image recording apparatus includes a sheet conveying device and is capable of double-sided image recording. The sheet conveying device includes a flap configured to pivot between a first state to close a main conveying path and to guide a sheet toward a return path, and a second state to allow a sheet to pass along the main conveying path.

SUMMARY

It may be beneficial to provide a sheet conveying device which is used for an image recording apparatus and in which a sheet having an image recorded thereon is reliably guided toward a return path without intruding back into a main conveying path.

According to one or more aspects of the disclosure, a sheet conveying device comprises a housing in which a sheet is conveyed along a first conveying path in a conveying direction and is returned along a second conveying path to the first conveying path, a first path-defining member, a second path-defining member facing the first path-defining member in a facing direction to define a portion of the first conveying path, and a flap configured to pivot between a first state in which the flap is in contact with the first path-defining member and guides toward the second conveying path the sheet conveyed in a direction opposite to the conveying direction, and a second state in which the flap is separated from the first path-defining member. The second conveying path is branched off from the first conveying path in a direction away from the first path-defining member. The first path-defining member includes a guide surface configured to guide the sheet conveyed along the first conveying path, a contact surface positioned farther from the second path-defining member in the facing direction than the guide surface, and configured to contact the flap in the first state, and an inclined surface positioned downstream of the contact surface in the conveying direction. The inclined surface is inclined such that an upstream end of the inclined surface in the conveying direction is closer to the second path-defining member in the facing direction than a downstream end of the inclined surface in the conveying direction. The upstream end of the inclined surface is closer to the second path-defining member in the facing direction than the contact surface.

With the above-described configuration, a sheet to be conveyed toward the second conveying path may be reduced or prevented from proceeding between the first path-defining member and the flap.

According to one or more aspects of the disclosure, a sheet conveying device comprises an upper guide member, a flap disposed facing the upper guide member to define a portion of a first conveying path, and a roller disposed along the first conveying path at a position downstream of the flap in a conveying direction. The flap is configured to pivot between a first state in which an upper end of the flap is in contact with the upper guide member, and a second state in which the upper end of the flap is spaced from the upper guide member. The roller is configured to rotate forwardly to convey a sheet along the first conveying path in the conveying direction and configured to rotate reversely to convey the sheet in a direction opposite to the conveying direction toward a second conveying path. The upper guide member includes a guide surface configured to guide the sheet conveyed along the first conveying path, a contact surface positioned above the guide surface and configured to contact the upper end of the flap in the first state, and an inclined surface positioned downstream of the contact surface in the conveying direction. The inclined surface is inclined such that an upstream end of the inclined surface in the conveying direction is lower than a downstream end of the inclined surface in the conveying direction. The upstream end of the inclined surface is lower than the contact surface.

With the above-described configuration, a sheet to be conveyed toward the second conveying path may be reduced or prevented from proceeding between the upper guide member and the flap.

DETAILED DESCRIPTION

Figure 1:
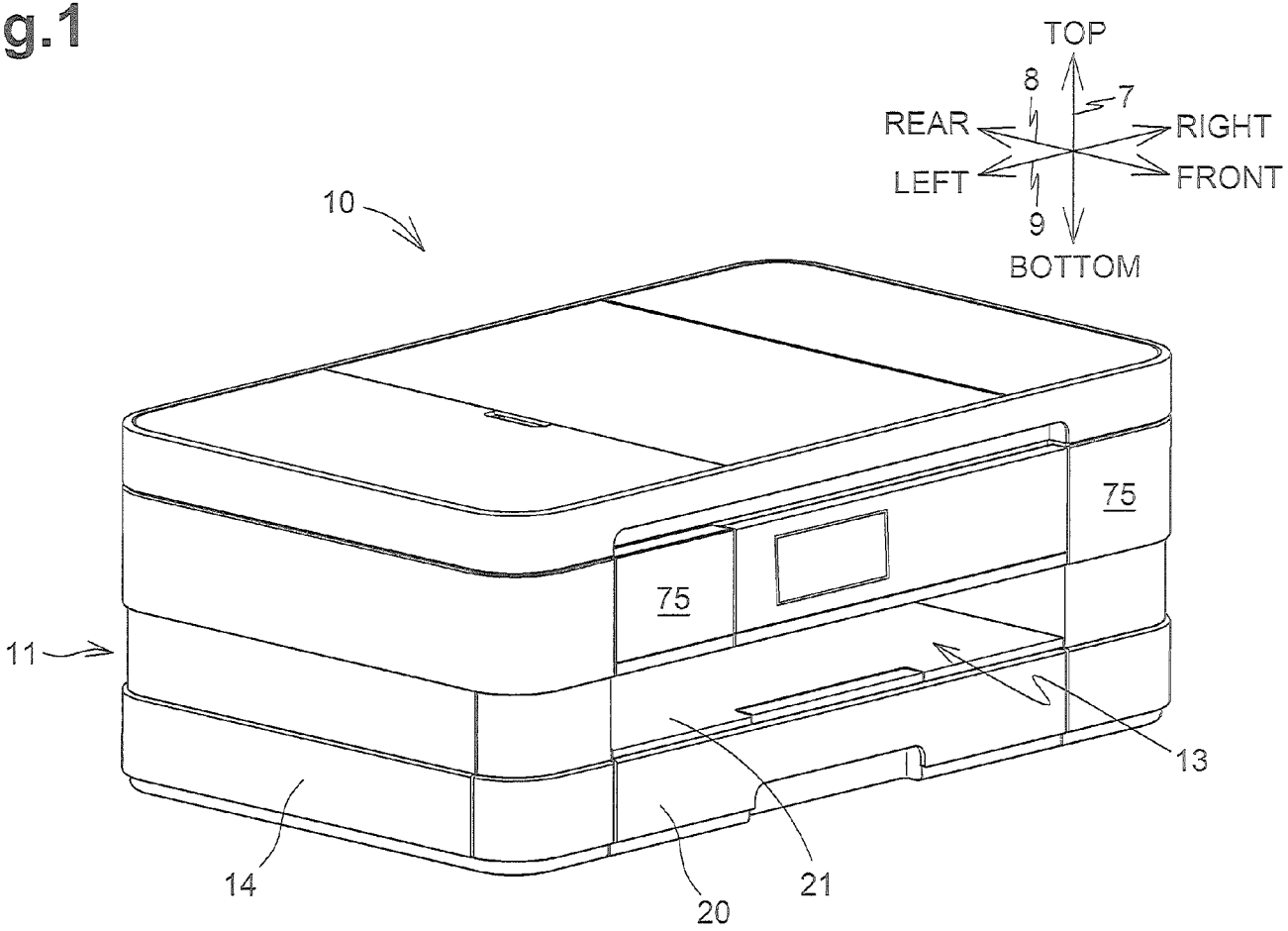
FIG. 1 is a perspective view of a multi-function device in an illustrative embodiment according to one or more aspects of the disclosure.

Illustrative embodiments and modifications according to one or more aspects of the disclosure are described in detail herein with reference to the accompanying drawings in which like reference numerals denote like corresponding parts. While the disclosure is described in detail with reference to specific embodiments thereof, this is merely an example, and various changes, arrangements and modifications may be applied therein without departing from the spirit and scope of the disclosure. In the following description, a top-bottom direction 7 may be defined in conjunction with an orientation in which a multi-function device 10 is intended to be used, as depicted in FIG. 1. A side of the multi-function device 10 having an opening 13 may be defined as a front side. A front-rear direction 8 may be defined in conjunction with the front side. A left-right direction 9 may be defined in conjunction with the multi-function device 10 as viewed from its front side.

[Overall Structure of Multi-Function Device 10]

As depicted in FIG. 1, an image recording apparatus, e.g., the multi-function device 10, has generally a thin rectangular parallelepiped shape. The multi-function device 10 includes a printer section 11 disposed at a lower portion thereof. The multi-function device 10 has various functions, such as a facsimile function, a printing function, and a copying function. As a printing function, the multi-function device 10 has a duplex printing function in which an image is recorded by an inkjet method on each side of a sheet, e.g., a recording sheet 12 (refer to FIG. 2). In another embodiment, the multi-function device 10 may be configured to record an image on a recording sheet 12 by a method other than the inkjet method, e.g., an electrophotographic method.

As depicted in FIG. 1, the printer section 11 includes a casing 14 including a front surface 75 on which an opening 13 is formed. The casing 14 defines therein a first conveying path 65 and a second conveying path 71 (refer to FIG. 2), which are described below. The casing 14 is an outer cover that encloses, for example, components of the printer section 11 therein.

The multi-function device 10 includes a sheet conveying device. The sheet conveying device includes the casing 14, and members defining the first conveying path 65, a flap 49, and coil springs 86, which are described below.

[Feed Tray 20]

Figure 2:
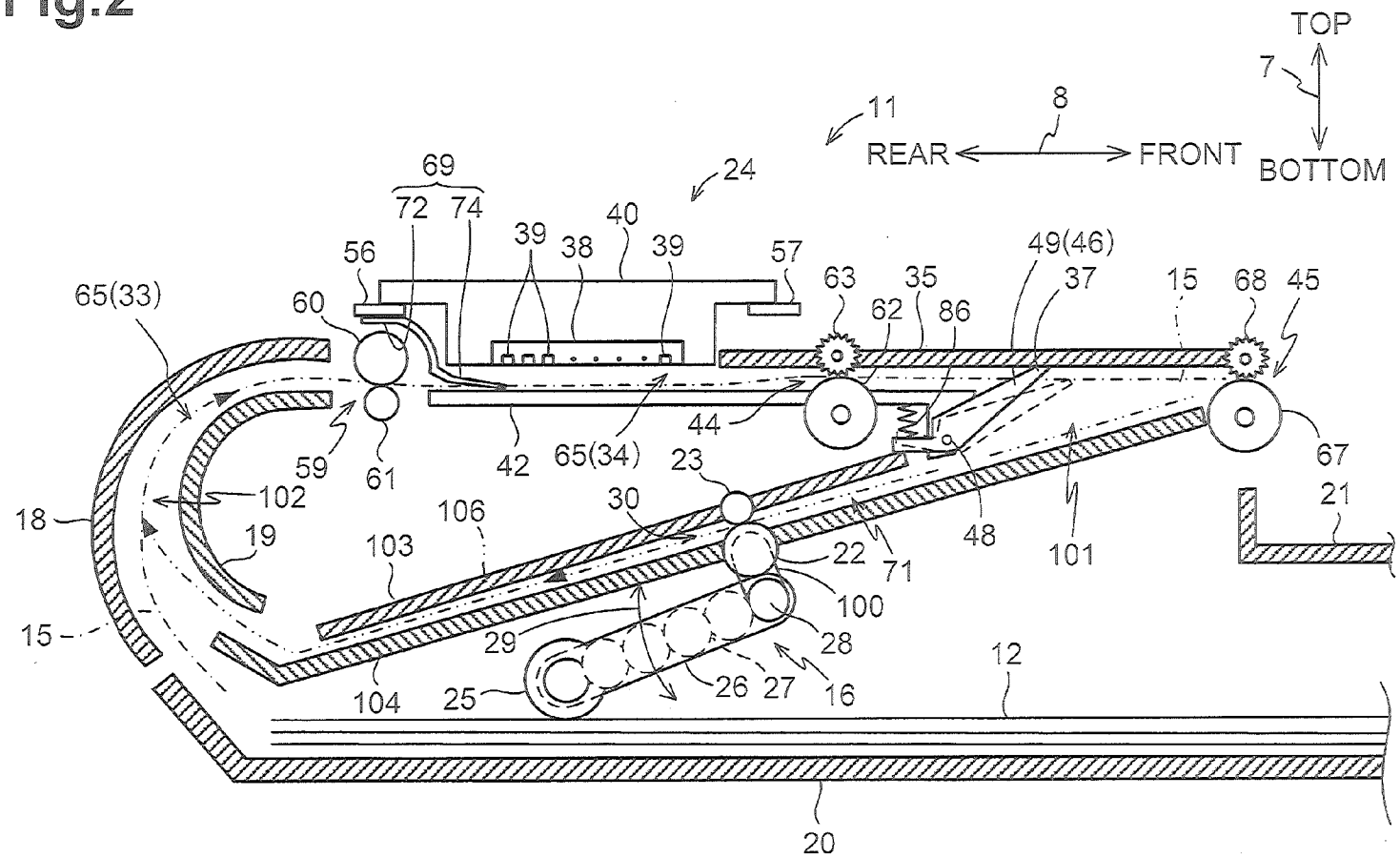
FIG. 2 is a vertical sectional view of a printer section, depicting an internal structure thereof.

As depicted in FIG. 1, the feed tray 20 is configured to be inserted into or removed from the casing 14 through a portion below the opening 13. As depicted in FIG. 2, the feed tray 20 is configured to support one or more recording sheets 12. A discharge tray 21 is supported above the feed tray 20. The discharge tray 21 is configured to support, at an upper surface thereof, a recording sheet 12 having an image recorded by a recording unit 24 (described below).

The feed tray 20 supports a pair of side guides (not depicted) configured to move in the left-right direction 9. Each side guide is configured to contact, at a side surface thereof, a corresponding one of left and right ends of a recording sheet 12 supported by the feed tray 20. In response to one of the side guides moving in one direction in the left-right direction 9, the other of the side guides moves in an opposite direction in the left-right direction 9. In the illustrative embodiment, a recording sheet 12 is supported by the feed tray 20 while center-aligned in the left-right direction 9 and is conveyed to the recording unit 24 through a first conveying path 65 and a second conveying path 71 (described below) for image recording. For example, the center of a recording sheet 12 in the left-right direction 9 of any size that can be supported by the feed tray 20 passes the same position in the first conveying path 65 and the second conveying path 71 in the left-right direction 9. In another embodiment, a recording sheet 12 may be side-aligned in the left-right direction 9 in the feed tray 20.

[Sheet Feed Unit 16]

As depicted in FIG. 2, a sheet feed unit 16 is disposed above the feed tray 20 when the feed tray 20 is inserted in the casing 14. The sheet feed unit 16 includes a feed roller 25, a feed arm 26, a drive force transmitting mechanism 27, and a shaft 28. The feed roller 25 is rotatably supported at an end of the feed arm 26. The feed arm 26 is configured to pivot in directions of arrows 29 about the shaft 28 provided at a base end portion of the feed arm 26. With such configuration, the feed roller 25 may contact and separate from a recording sheet 12 supported by the feed tray 20.

The feed roller 25 is configured to be rotated by drive force transmitted thereto from a conveying motor (not depicted) by the drive force transmitting mechanism 27 including a plurality of engaging gears. With such configuration, a topmost recording sheet 12 contacting the feed roller 25 among recording sheets 12 supported by the feed tray 20 is fed to the first conveying path 65. In another embodiment, the feed roller 25 may be configured to be rotated by drive force from a motor that is provided separately from the conveying motor.

[First Conveying Path 65]

As depicted in FIG. 2, the first conveying path 65 extends from a rear end portion of the feed tray 20 inside the casing 14. The first conveying path 65 includes a curved path 33 and a linear path 34. The curved path 33 extends upward from the rear end portion of the feed tray 20 while curving, and is connected to the linear path 34 at a connecting position located behind a conveying roller pair 59 (described below). The linear path 34 extends in the front-rear direction 8 from the connecting position to a switchback roller pair 45 (described below).

Figure 5:
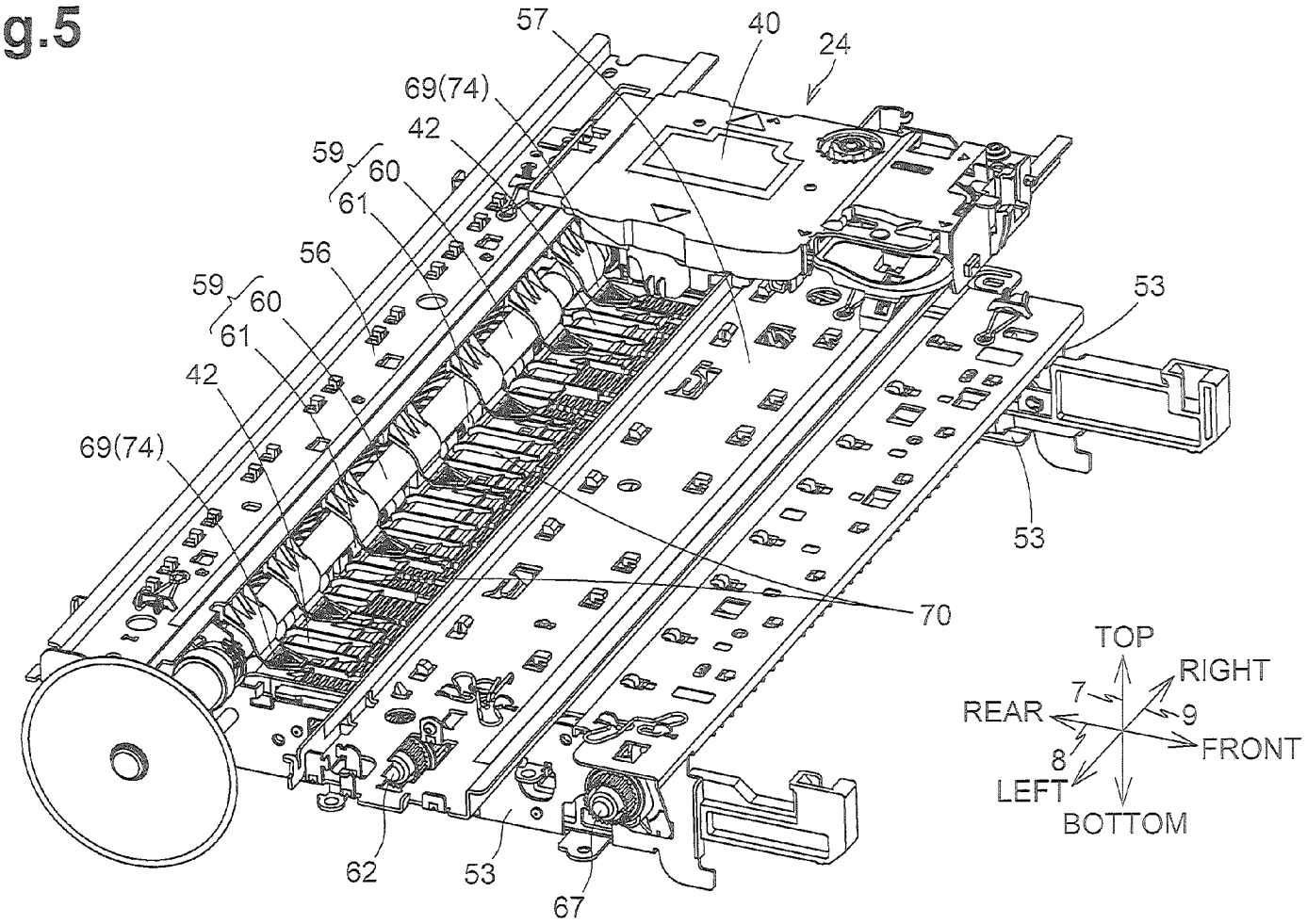
FIG. 5 is a perspective view of a recording unit and guide rails and their surrounding components in the printer section.

The curved path 33 is defined by an outer guide member 18 and an inner guide member 19 that face each other with a predetermined distance therebetween. A portion of the linear path 34 is defined by the recording unit 24 and a second path-defining member, e.g., a platen 42, that face each other with a predetermined distance therebetween. Another portion of the linear path 34 is defined behind the recording unit 24 by a conveying roller 60 and pinch rollers 61 (as depicted in FIG. 5) that face the conveying roller 60. Still another portion of the linear path 34 is defined in front of the recording unit 24 by a first path-defining member, e.g., a first upper guide member 35, and the platen 42 that face each other with a predetermined distance therebetween, a discharge roller 62 and spurs 63 (only one spur 63 depicted in FIG. 2) that face the discharge roller 62, the first upper guide member 35 and the flap 49 that face each other, and a switchback roller 67 and spurs 68 (only one spur 68 depicted in FIG. 2) that face the switchback roller 67. The first upper guide member 35 will be described in detail later.

A recording sheet 12 supported by the feed tray 20 is fed by the feed roller 25 to the curved path 33. The recording sheet 12 is then conveyed from the curved path 33 to the linear path 34 along a conveying direction 15, as depicted by a dot-and-dash line with an arrow in FIG. 2.

[Recording Unit 24]

As depicted in FIGS. 2 and 3, the recording unit 24 is disposed above the linear path 34. The platen 42 (refer to FIG. 4) is disposed below the linear path 34 to face the recording unit 24 and the first upper guide member 35. The platen 42 is configured to support a recording sheet 12 conveyed along the first conveying path 65.

The recording unit 24 includes a carriage 40 and a recording head 38. The carriage 40 is movably supported by a guide rail 56 and a guide rail 57 (refer to FIG. 4) that are spaced from each other in the front-rear direction 8. The carriage 40 is configured to reciprocate in the left-right direction 9. Left and right ends of the respective guide rails 56 and 57 are supported by side frames 53 (refer to FIG. 5). The side frames 53 are disposed to the right and left of the linear path 34.

The recording head 38 is mounted on the carriage 40. Ink is supplied to the recording head 38 from an ink cartridge (not depicted). The recording head 38 includes nozzles 39 formed at a lower surface thereof. The recording head 38 is configured to eject ink droplets from the nozzles 39 toward the platen 42 while the carriage 40 is moving in the left-right direction 9. Thus, an image is recorded on a recording sheet 12 supported by the platen 42.

[Corrugation Mechanism]

The printer section 11 includes a corrugation mechanism. The corrugation mechanism includes contact members 69 (refer to FIGS. 2 and 3) and platen ribs 70 (refer to FIGS. 3-5).

The contact members 69 as depicted in FIGS. 2 and 3 are configured to contact, from above, a recording sheet 12 conveyed along the first conveying path 65. As depicted in FIG. 5, the contact members 69 are spaced from each other in the left-right direction 9. The platen ribs 70 as depicted in FIGS. 3-5 protrude upward from an upper surface of the platen 42 and extend in the front-rear direction 8. As depicted in FIGS. 4 and 5, the platen ribs 70 are spaced from each other in the left-right direction 9. Each platen rib 70 is disposed between corresponding two contact members 69 adjacent to each other in the left-right direction 9.

As depicted in FIGS. 2 and 3, each contact member 69 includes a base end portion 72 and an extending portion 74 extending frontward and downward from the base end portion 72 while curving.

The base end portion 72 is located behind the conveying roller pair 59. The base end portion 72 is attached to a lower surface 73 of the guide rail 56. A known method may be used to attach the base end portion 72 to the guide rail 56. The known method may include engaging the base end portion 72 with the guide rail 56 and screwing the base end portion 72 to the guide rail 56.

The extending portion 74 is located between the nozzles 39 and a nip position of the conveying roller pair 59 in the conveying direction 15. The extending portion 74 extends toward a downstream side in the conveying direction 15 beyond upstream ends of the platen ribs 70 in the conveying direction 15.

Figure 6:
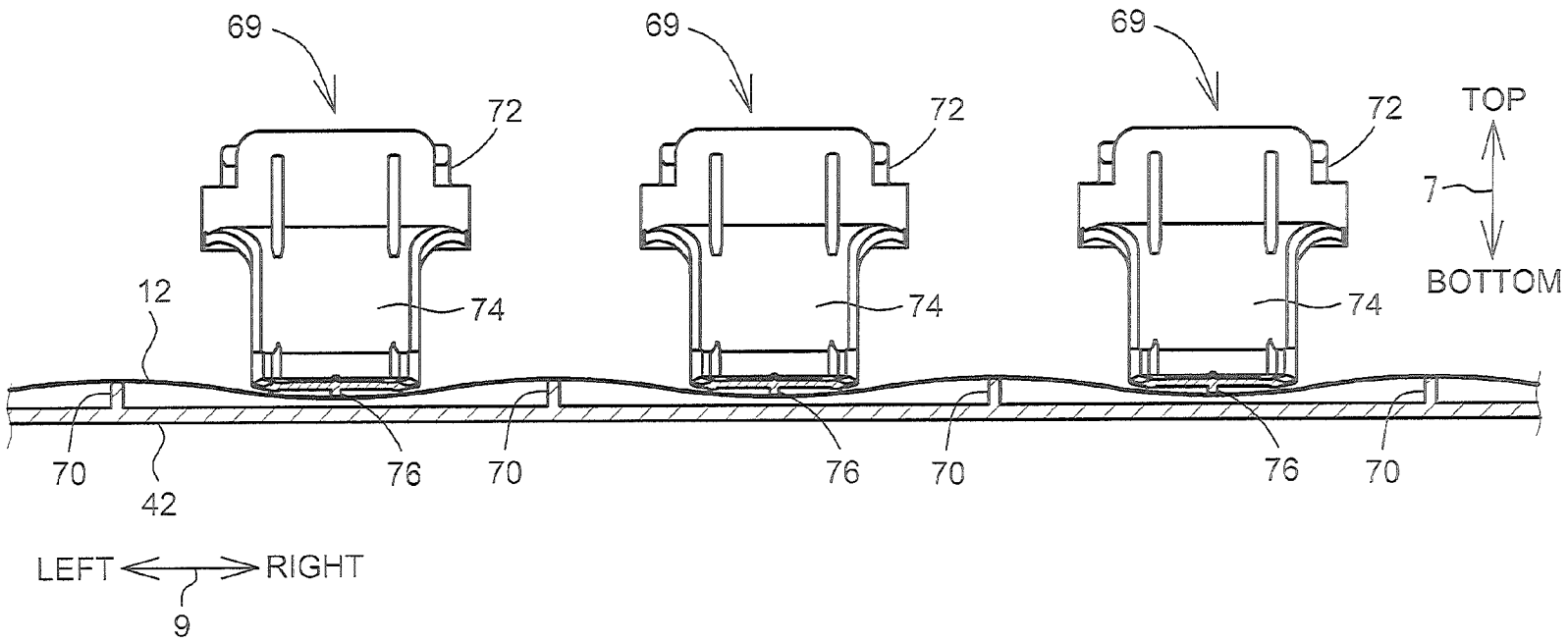
FIG. 6 is a sectional view of contact members, the platen, and a recording sheet.

As depicted in FIG. 6, contact ribs 76 extending in the front-rear direction 8 are formed on lower surfaces of the respective extending portions 74. The contact ribs 76 are configured to contact an upper surface of a recording sheet 12 conveyed along the linear path 34. A recording sheet 12 is corrugated in the left-right direction 9 (refer to FIG. 6) as the contact ribs 76 contact the recording sheet 12 from above and the platen ribs 70 contact the recording sheet 12 from below. The contact members 69 and the platen ribs 70 thus cooperate with each other to corrugate a recording sheet 12 conveyed along the first conveying path 65.

[Conveying Roller Pair 59, Discharge Roller Pair 44, and Switchback Roller Pair 45]

As depicted in FIGS. 2 and 3, the conveying roller pair 59 is disposed in the linear path 34 upstream of the recording unit 24 in the conveying direction 15. A discharge roller pair 44 is disposed in the linear path 34 downstream of the recording unit 24 in the conveying direction 15. The switchback roller pair 45 is disposed in the linear path 34 downstream of the discharge roller pair 44 in the conveying direction 15.

The conveying roller pair 59 includes the conveying roller 60 disposed above the linear path 34 and the pinch rollers 61 disposed below the linear path 34 to face the conveying roller 60. The discharge roller pair 44 includes the discharge roller 62 disposed below the linear path 34, and the spurs 63 disposed above the linear path 34 to face the discharge roller 62. The switchback roller pair 45 includes the switchback roller 67 disposed below the linear path 34, and the spurs 68 disposed above the linear path 34 to face the switchback roller 67.

The pinch rollers 61 are urged by third coil springs 66 toward the conveying roller 60. The discharge roller 62 is urged by second coil springs 94 toward the spurs 63. The switchback roller 67 is urged by first coil springs 92 toward the spurs 68. With such structure, the respective roller pairs 59, 44, and 45 are configured to nip a recording sheet 12 in the first conveying path 65.

The discharge roller 62 and the switchback roller 67 that are disposed on a lower side in the roller pairs 44 and 45, respectively, are rotatably supported by the side frames 53 (refer to FIG. 5).

Each of the conveying roller 60, the discharge roller 62, and the switchback roller 67 is configured to forwardly rotate as forward rotation driving force is transmitted thereto from a conveying motor (not depicted), and to reversely rotate as reverse rotation driving force is transmitted thereto. Each pinch roller 61 is configured to be rotated by the rotation of the conveying roller 60. Each spur 63 is configured to be rotated by the rotation of the discharge roller 62. Each spur 68 is configured to be rotated by the rotation of the switchback roller 67.

As the respective rollers 60, 62, and 67 forwardly rotate while the roller pairs 59, 44, and 45 nip a recording sheet 12, the recording sheet 12 is conveyed in the conveying direction 15. As the respective rollers 60, 62, and 67 are reversely rotate, the recording sheet 12 is conveyed in a direction opposite to the conveying direction 15.

[Second Conveying Path 71]

As depicted in FIG. 2, the second conveying path 71 is defined below the linear path 34 and above the feed roller 25. The second conveying path 71 is branched off from the linear path 34 at a junction, e.g., a branch position 101, that is located downstream of the discharge roller pair 44 in the conveying direction 15 and upstream of the switchback roller pair 45 in the conveying direction 15. In one example, the second conveying path 71 is branched off from a side of the linear path 34 closer to the platen 42 in the top-bottom direction 7 in which the first upper guide member 35 and the platen 42 face each other, e.g., a lower side of the linear path 34. In other words, the second conveying path 71 is branched off from the linear path 34 downward away from the first upper guide member 35. The second conveying path 71 merges with the curved path 33 at a merge position 102 located upstream of the conveying roller pair 59 in the conveying direction 15. The second conveying path 71 is defined by a second upper guide member 103 and a second lower guide member 104 that face each other with a predetermined distance therebetween.

[Return Roller Pair 30]

As depicted in FIG. 2, a return roller pair 30 is disposed in the second conveying path 71. The return roller pair 30 includes a return roller 22 disposed below the second conveying path 71 and a follower roller 23 disposed above the second conveying path 71 to face the return roller 22. The return roller 22 is rotatably supported at an end of a return arm 100. The return roller 22 is driven by the conveying motor. The follower roller 23 is configured to be rotated by the rotation of the return roller 22. The return roller 22 is configured to forwardly rotate when forward rotation drive force or reverse rotation drive force is transmitted thereto from the conveying motor. As the return roller 22 forwardly rotates while the return roller pair 30 nips a recording sheet 12, the recording sheet 12 is conveyed along the second conveying path 71 in a sheet return direction 106, which is directed from the branch position 101 to the merge position 102, (e.g., in a direction depicted by a two-dot chain line in FIG. 2).

[Flap 49]

As depicted in FIG. 2, the flap 49 is disposed in the linear path 34 between the discharge roller pair 44 and the switchback roller pair 45. In one example, the flap 49 is disposed at the branch position 101. The flap 49 is disposed facing the first upper guide member 35 in the top-bottom direction 7.

The flap 49 is configured to pivot between a first state and a second state. In the first state (as depicted by a solid line in FIG. 2 and in FIG. 3A), the flap 49 closes the first conveying path 65 by contacting the first upper guide member 35. In the second state (as depicted by a broken line in FIG. 2 and in FIG. 3B), a portion of the flap 49 is located lower than when the flap 49 is in the first state. The flap 49 in the second state is separated from the first upper guide member 35 to allow a recording sheet 12 to pass in the conveying direction 15. A distal end or an upper end (e.g., a front end portion 37) of the flap 49 in the second state is positioned lower than the distal end of the flap 49 in the first state.

Figure 7:
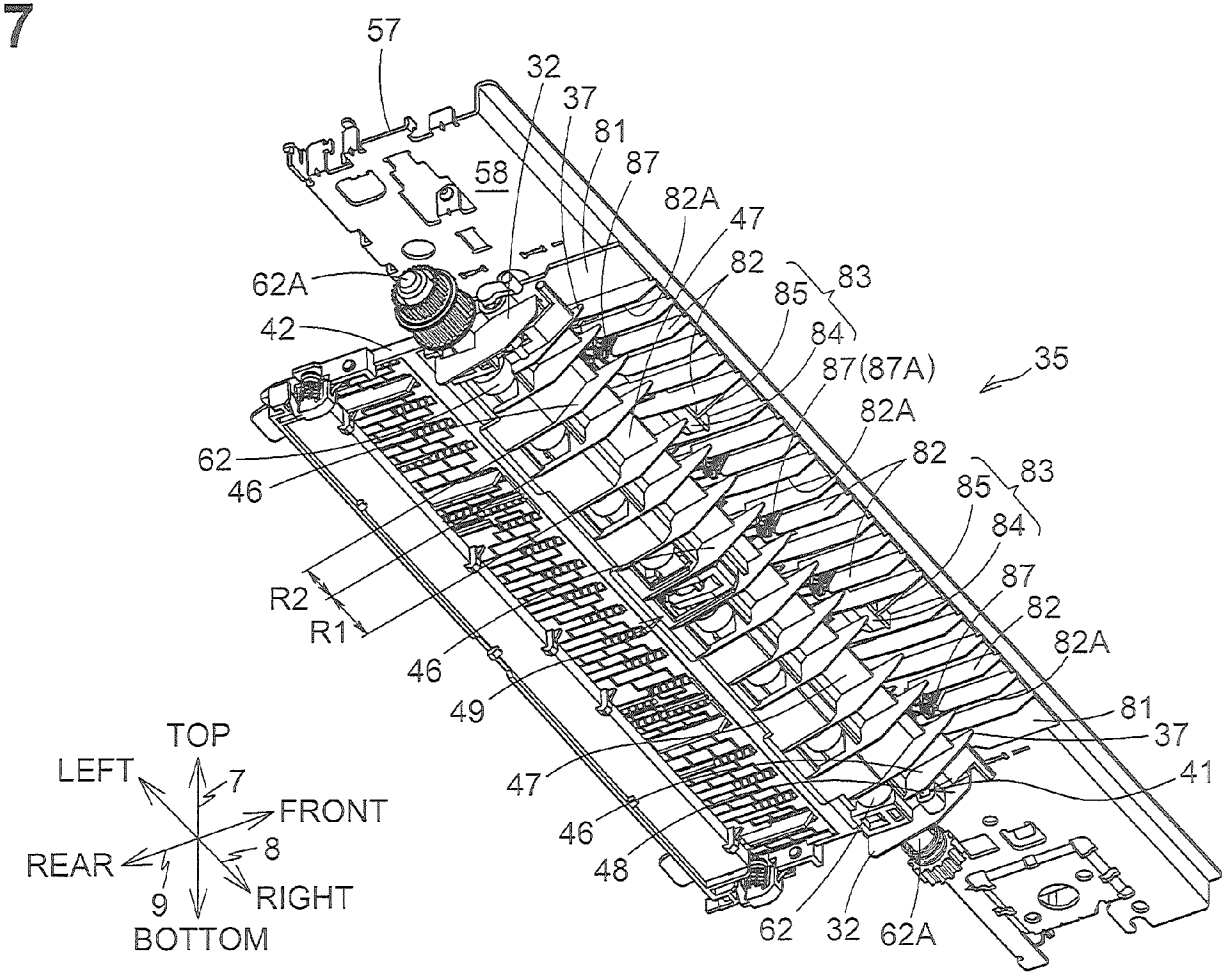
FIG. 7 is a perspective view of the flap, a first upper guide member, the platen, and the guide rail as viewed from the bottom.

As depicted in FIG. 7, the flap 49 includes a plurality of plate members 46, a connecting member 47, and protruding portions 48. The plate members 46 are spaced apart from each other in the left-right direction 9. Each plate member 46 has a dimension in the left-right direction 9 shorter than dimensions thereof in the top-bottom direction 7 and the front-rear direction 8. The connecting member 47 connects the plurality of plate members 46. One of the protruding portions 48 protrudes rightward from the rightmost plate member 46 and the other protruding portion 48 protrudes leftward from the leftmost plate member 46. In the illustrative embodiment, the plate members 46, the connecting member 47, and the protruding portions 48 are integrally formed with each other. In another embodiment, the plate members 46, the connecting member 47, and the protruding portions 48 may be assembled by being engaged with each other.

The flap 49 is supported by the platen 42 to pivot between the first state and the second state. In one example, the platen 42 includes a pair of protruding portions 32, each protruding frontward from a corresponding one of left and right front end portions of the platen 42, as depicted in FIG. 7. The flap 49 is disposed between the protruding portions 32. A recessed portion 41 is located at an inner surface of each protruding portion 32. Each protruding portion 48 of the flap 49 is inserted into a corresponding recessed portion 41. Thus, the flap 49 is pivotally supported by the platen 42 about the protruding portions 48. In another embodiment, the flap 49 may be supported by a member other than the platen 42, e.g., the second upper guide member 103, as long as the flap 49 defines the first conveying path 65 by facing the first upper guide member 35.

As depicted in FIG. 2, the flap 49 is urged upward by urging members, e.g., coil springs 86 (only one of which is depicted in FIG. 2). One end of each coil spring 86 is connected to the flap 49. The other end of each coil spring 86 is connected to the platen 42. When the flap 49 is in the first state, applicable ones of the front end portions 37 of the plate members 46 contact respective contact surfaces 84 formed at the first upper guide member 35 as the flap 49 is urged by the coil springs 86. For example, the coil springs 86 urge the flap 49 such that the flap 49 is placed in the first state. The contact surfaces 84 will be described in detail later.

Figure 3A:
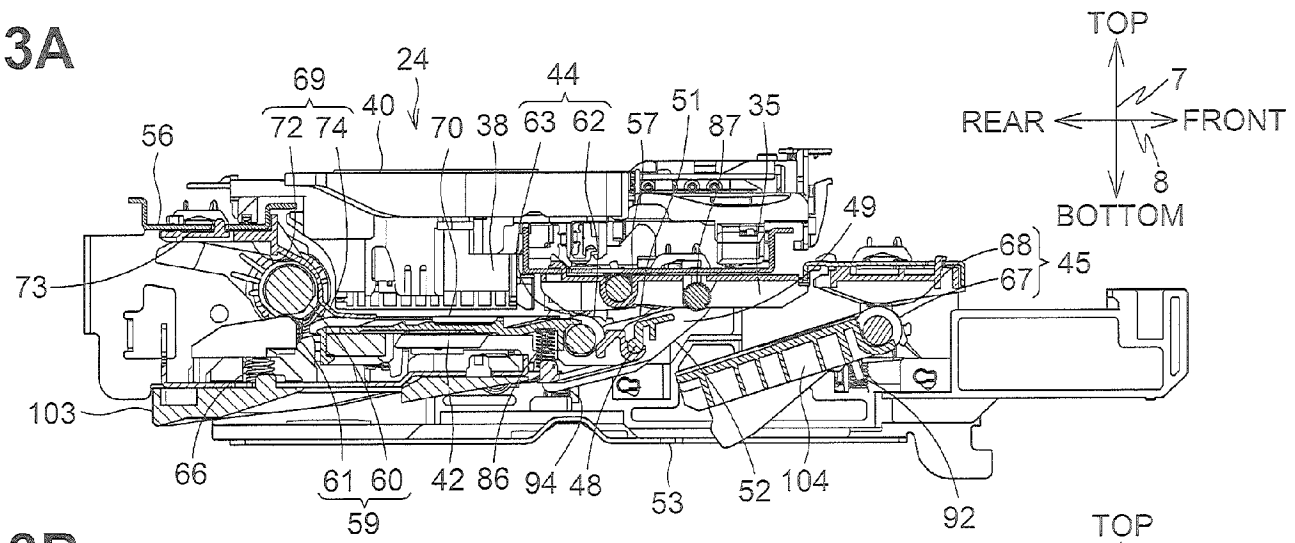
FIG. 3A is a vertical sectional view of a flap and its surrounding components in the printer section, when the flap is in a first state.
Figure 3B:
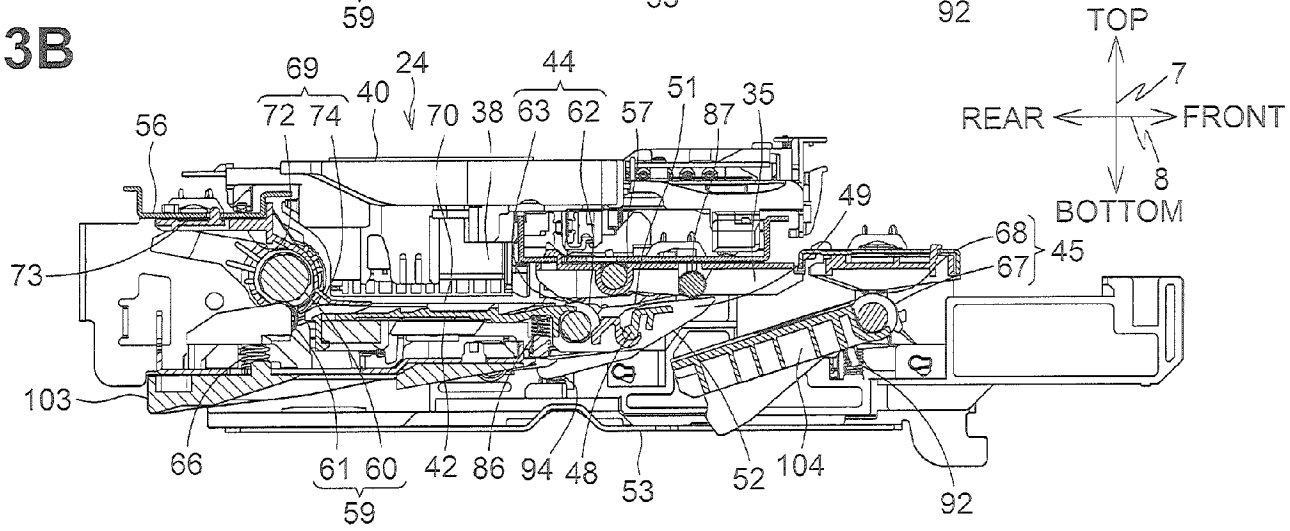
FIG. 3B is a vertical sectional view of the flap and its surrounding components in the printer section, when the flap is in a second state.
Figure 4:
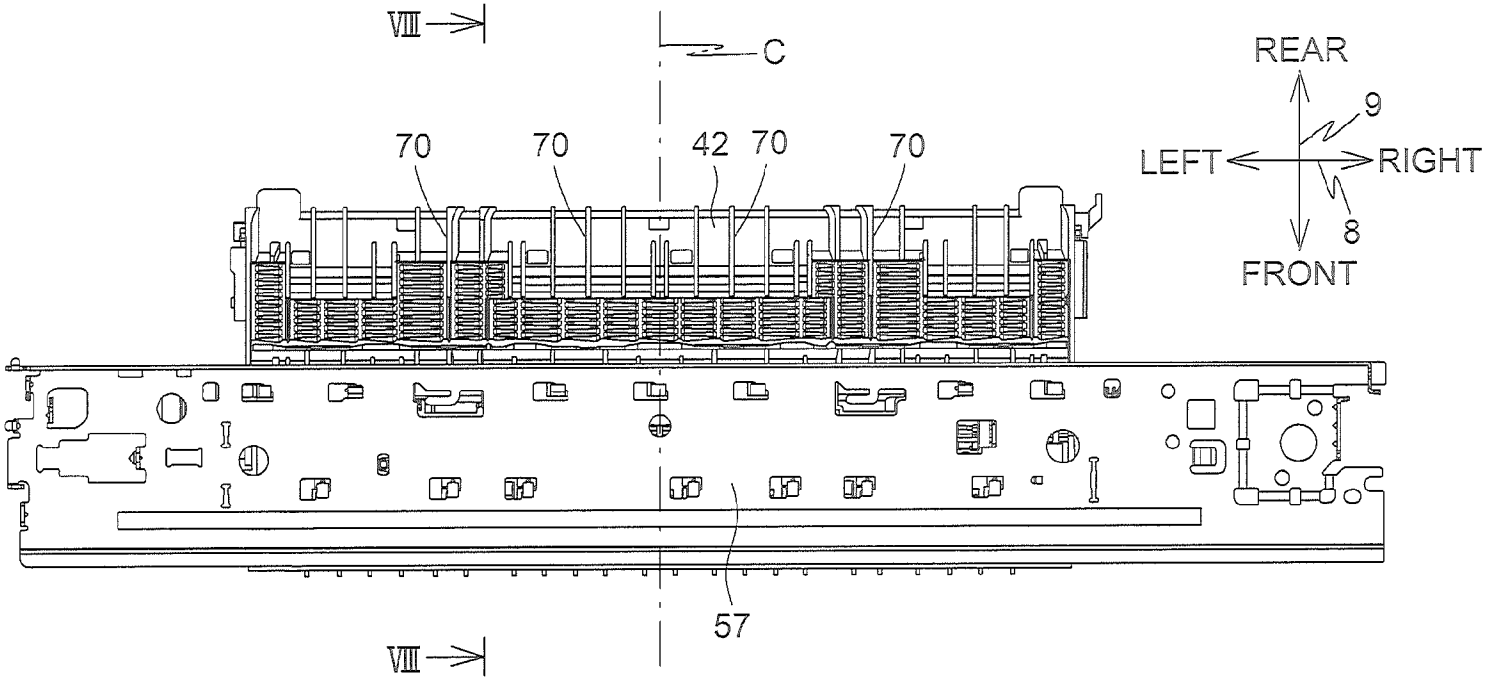
FIG. 4 is a plan view of a platen and a guide rail.

When external force (except force from the coil springs 86) is not applied to the flap 49, the flap 49 is placed in the first state while being urged by the coil springs 86 (refer to FIG. 3A). A recording sheet 12 having an image recorded thereon by the recording unit 24 contacts upper surfaces 51 of the plate members 46 of the flap 49 while being conveyed by the discharge roller pair 44 along the linear path 34 in the conveying direction 15. The recording sheet 12 presses down the front end portions 37 of the flap 49 against the urging force of the coil springs 86. Thus, the flap 49 pivots to the second state (refer to FIG. 3B). An imaginary plane containing the upper surfaces 51 of the plurality of plate members 46 guides the recording sheet 12 contacting the upper surfaces 51. When the recording sheet 12 is conveyed in the conveying direction 15, the rollers 60, 62, 67, and 22 forwardly rotate.

As the recording sheet 12 contacts the flap 49, the flap 49 pivots in a direction away from the first upper guide member 35 and is placed in the second state. For example, the flap 49 in the second state is separated from the first upper guide member 35. Thereafter, when the trailing end of the recording sheet 12, which is conveyed in the conveying direction 15 by the switchback roller 67 forwardly rotating, has passed the flap 49, the flap 49, which is urged by the coil springs 86, pivots from the second state to the first state.

In this state, as the switchback roller 67 is kept forwardly rotating, the switchback roller pair 45 conveys the recording sheet 12 in the conveying direction 15 to discharge the recording sheet 12 to the discharge tray 21. As the switchback roller 67 rotates forwardly to reversely, the switchback roller pair 45 conveys the recording sheet 12 in a direction opposite to the conveying direction 15.

The trailing end of the recording sheet 12 in the conveying direction 15 that is conveyed in a direction opposite to the conveying direction 15, contacts inclined surfaces 85 formed in the first upper guide member 35. The inclined surfaces 85 will be described in detail later. The recording sheet 12 is guided to the second conveying path 71 along the inclined surfaces 85, and then along lower surfaces 52 of the plate members 46 of the flap 49. For example, the flap 49 in the first state is configured to guide to the second conveying path 71 the recording sheet 12 that is conveyed in a direction opposite to the conveying direction 15 by the switchback roller pair 45 reversely rotating. The recording sheet 12 enters the second conveying path 71 with the trailing end thereof in the conveying direction 15 as the leading end. Consequently, the recording sheet 12 enters from the second conveying path 71 to the first conveying path 65 again, as will be described below. Thus, the recording sheet 12 may be turned over. As the switchback roller 67 rotates forwardly to reversely, the conveying roller 60 and the discharge roller 62 also rotate forwardly to reversely, but the return roller 22 keeps forwardly rotating.

The recording sheet 12 guided to the second conveying path 71 is further conveyed in the return direction 106 by the return roller pair 30. The recording sheet 12 conveyed along the second conveying path 71 in the return direction 106 is conveyed again along the curved path 33 in the conveying direction 15 via the merge position 102. Thereafter, the recording sheet 12 reaches the conveying roller pair 59. As the rollers 60, 62, and 67 rotate reversely to forwardly (though the return roller 22 keeps forwardly rotating), the recording sheet 12 is conveyed by the conveying roller pair 59 in the conveying direction 15, and reaches a position below the recording unit 24. At this time, the back side of the recording sheet 12 faces the recording unit 24. The recording unit 24 records an image on the back side of the recording sheet 12. Thereafter, the recording sheet 12 having an image recorded on both sides thereof is conveyed in the conveying direction 15 by the discharge roller pair 44 and the switchback roller pair 45 and is discharged onto the discharge tray 21. As described above, a recording sheet 12 conveyed along the second conveying path 71 in the return direction 106 is returned to the first conveying path 65, so that the recording sheet 12 is turned over.

[First Upper Guide Member 35]

As depicted in FIGS. 2 and 3, the first upper guide member 35 is disposed between the recording head 38 and the switchback roller pair 45 in the conveying direction 15. The first upper guide member 35 is disposed facing the platen 42, the discharge roller 62, and the flap 49 in a facing direction, e.g., in the top-bottom direction 7. The first upper guide member 35 defines from above the first conveying path 65. The first upper guide member 35 rotatably supports the spurs 63 and 68. The platen 42, the discharge roller 62, and the flap 49 define from below the first conveying path 65.

As depicted in FIG. 7, the first upper guide member 35 includes a base portion 81 having a generally plate shape whose dimensions in the front-rear direction 8 and the left-right direction 9 are longer than a dimension thereof in the top-bottom direction 7, a plurality of ribs 82 disposed at a lower surface of the base portion 81, and contact portions 83 disposed at a lower surface of the base portion 81. In the illustrative embodiment, the base portion 81, the ribs 82, and the contact portions 83 are integrally formed with each other. In another embodiment, the base portion 81, the ribs 82, and the contact portions 83 may be assembled by being engaged with each other.

An upper surface of the base portion 81 is attached to a lower surface 58 of the guide rail 57. For example, the first upper guide member 35 is supported by the guide rail 57. A known method may be used to attach the base portion 81 to the guide rail 57. The known method may include engaging the base portion 81 to the guide rail 57 and screwing the base portion 81 to the guide rail 57.

The ribs 82 are spaced apart from each other in a width direction, e.g., the left-right direction 9, crossing or orthogonal to the conveying direction 15. Each rib 82 protrudes downward, for example, toward the platen 42 in the top-bottom direction 7. Each rib 82 extends along the front-rear direction 8, e.g., along the conveying direction 15. An upper surface of a recording sheet 12 conveyed along the first conveying path 65 contacts protruding ends 82A of the ribs 82 extending along the front-rear direction 8. Thus, the upper surface of the recording sheet 12 may be guided by the protruding ends 82A. For example, an imaginary plane containing the protruding ends 82A of the ribs 82 guides a recording sheet 12 conveyed along the first conveying path 65. The imaginary plane containing the protruding ends 82A of the ribs 82 is an example of a guide surface.

Each rib 82 is located, in the left-right direction 9, between corresponding adjacent two of the plate members 46 of the flap 49.

Figure 8:
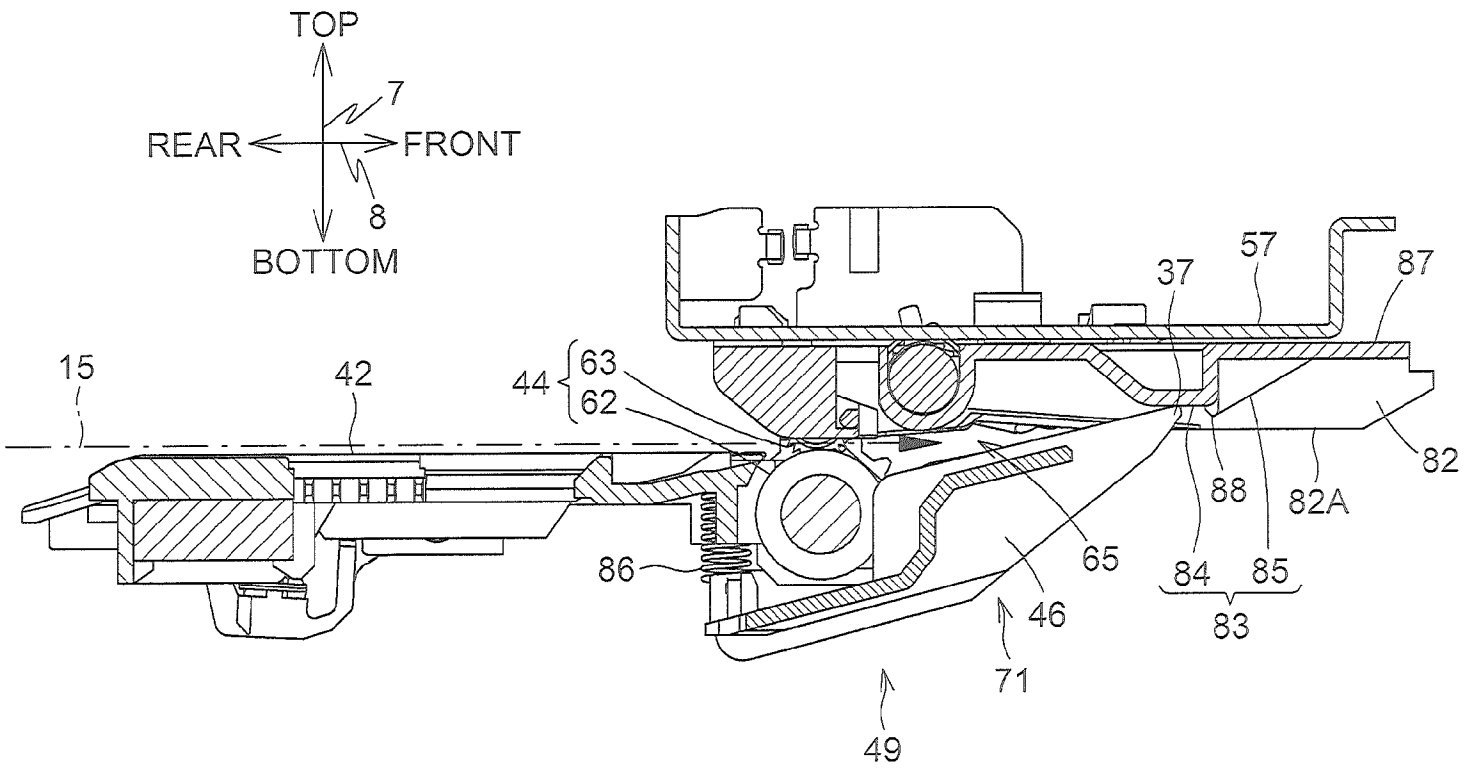
FIG. 8 is a sectional view of the platen and the guide rail taken along a line VIII-VIII of FIG. 4.

The contact portions 83, as depicted in FIGS. 7 and 8, are disposed between the discharge roller pair 44 and the switchback roller pair 45 in the conveying direction 15. Each contact portion 83 protrudes downward from a lower surface of the base portion 81. Each contact portion 83 is disposed between a corresponding pair of adjacent ribs 82 in the left-right direction 9. Each contact portion 83 includes a contact surface 84 and an inclined surface 85.

The contact surface 84 extends in the front-rear direction 8 and the left-right direction 9. In another embodiment, the contact surface 84 may be inclined relative to a plane extending in the front-rear direction 8 and the left-right direction 9. The contact surface 84 is located above the protruding ends 82A of the ribs 82, e.g., at a position away from the platen 42 in the top-bottom direction 7.

Two contact surfaces 84 are symmetrical in the left-right direction 9, with respect to a center (e.g., a center C in FIG. 4) of a zone in the left-right direction 9 where a recording sheet 12 passes along the first conveying path 65. The center C of the zone corresponds to a position in the left-right direction 9 of a third spur 87A from the right, among five spurs 87 spaced from each other in the left-right direction 9, as depicted in FIG. 7.

As depicted in FIG. 7, a distance R1 in the left-right direction 9 between a pair of adjacent ribs 82 facing each other while sandwiching a contact surface 84 is longer than a distance R2 in the left-right direction 9 between another pair of adjacent ribs 82 facing each other without sandwiching a contact surface 84.

The right end of each contact surface 84 is connected to a corresponding rib 82 disposed on the right side of the contact surface 84. The left end of each contact surface 84 is connected to a corresponding rib 82 disposed on the left side of the contact surface 84. In another embodiment, the contact surface 84 may be spaced apart from its corresponding rib 82 in the left-right direction 9.

As depicted in FIG. 8, each contact surface 84 face, from above, the front end portions 37 of a corresponding plate member 46 of the flap 49. With such structure, when the flap 49 is in the first state, the front end portion 37 of the corresponding plate member 46 contacts the contact surface 84 from below. For example, the flap 49 in the first state contacts the contact surfaces 84 between the discharge roller pair 44 and the switchback roller pair 45.

As described above, the first upper guide member 35 has two contact surfaces 84 in the illustrative embodiment. Accordingly, among the plurality of plate members 46, the front end portions 37 of two plate members 46 facing the respective contact surfaces 84 contact the respective contact surfaces 84 when the flap 49 is in the first state. The front end portions 37 of other plate members 46 that do not face the contact surfaces 84 do not contact any portions of the first upper guide member 35 when the flap 49 is in the first state.

Each inclined surface 85 is located downstream of a corresponding contact surface 84 in the conveying direction 15. The inclined surface 85 is inclined such that the surface 85 extends downward from the front to the rear, e.g., from a downstream side to an upstream side in the conveying direction 15. For example, the inclined surface 85 extends further toward the lower guide member 104 from an upstream side to a downstream side in a direction opposite to the conveying direction 15.

A lower end portion 88 of the inclined surface 85 is positioned lower than the contact surface 84. For example, an upstream end of the inclined surface 85 in the conveying direction 15 (e.g., the lower end portion 88) is closer to the platen 42 than the contact surface 84 in the top-bottom direction 7.

The right end of the inclined surface 85 is spaced apart from a rib 82 disposed on the right side of the inclined surface 85. The left end of the inclined surface 85 is spaced from a rib 82 disposed on the left side of the inclined surface 85. In another embodiment, the inclined surface 85 may be connected to the ribs 82 in the left-right direction 9.

Effects of Illustrative Embodiment

According to the above-described illustrative embodiment, a recording sheet 12 to be conveyed toward the second conveying path 71 contacts the inclined surfaces 85 and is directed toward the second conveying path 71. Thereafter, the recording sheet 12 is guided to the second conveying path 71 by the flap 49 in the first state. Upstream ends of the inclined surfaces 85 in the conveying direction 15 (e.g., the lower end portions 88) are positioned lower than the respective contact surfaces 84. Accordingly, when the recording sheet 12 is conveyed toward the second conveying path 71, entry of the recording sheet 12 between the flap 49 and the first upper guide member 35 may be reduced or prevented. Thus, the recording sheet 12 may be guided to the second conveying path 71 reliably.

According to the above-described illustrative embodiment, two contact surfaces 84 are symmetrical with respect to the center C (refer to FIG. 4) in the left-right direction 9 of the zone where a recording sheet 12 passes along the first conveying path 65. Accordingly, recording sheets 12 of various sizes with their center aligned with the center C may be guided to the second conveying path 71 more reliably.

According to the above-described illustrative embodiment, a contact surface 84 and its corresponding inclined surface 85 are located between a pair of adjacent ribs 82 which are spaced from each other in the left-right direction 9 by a longer distance (e.g., the distance R1). This may allow a recording sheet 12 to readily proceed along the flap 49 in the first state. Accordingly, the recording sheet 12 may be guided to the second conveying path 71 more reliably.

According to the above-described illustrative embodiment, the multi-function device 10 includes the coil springs 86 configured to urge the flap 49 into the first state. With the coil springs 86, when a recording sheet 12 is conveyed toward the second conveying path 71, entry of a recording sheet 12 between the flap 49 and the first upper guide member 35 may be reduced or prevented more effectively.

According to the above-described illustrative embodiment, the multi-function device 10 includes a corrugation mechanism configured to corrugate a recording sheet 12. A corrugated recording sheet 12 that is likely to readily proceed along the flap 49 in the first state may be guided to the second conveying path 71 more reliably.

Modifications

Figure 9:
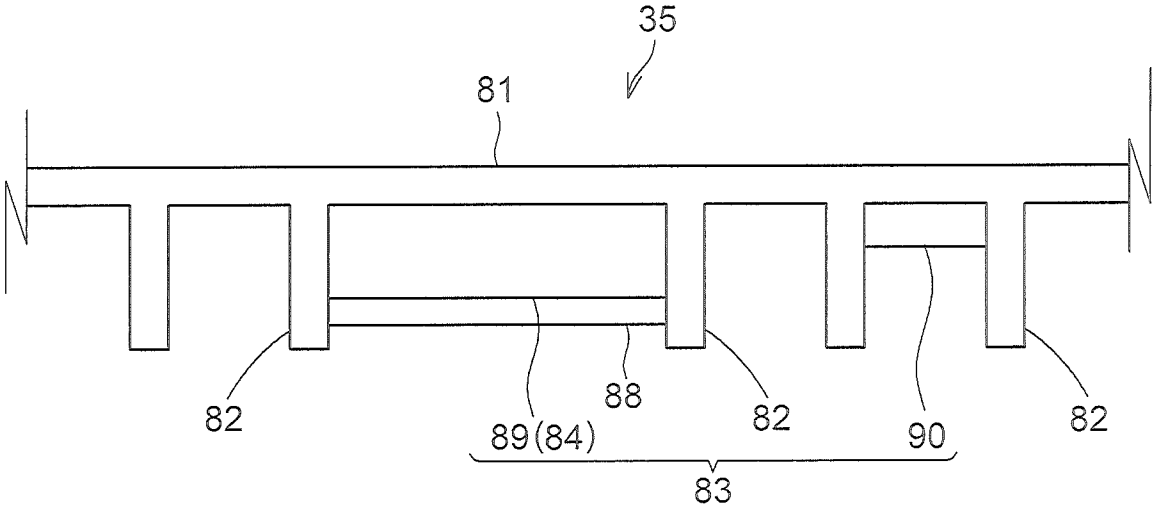
FIG. 9 is a schematic front view of a first upper guide member according to a modification of an embodiment.

As depicted in FIG. 9, a contact portion 83 may include a first contact surface 89 and a second contact surface 90, each serving as a contact surface configured to contact the flap 49. The first contact surface 89 corresponds to the contact surface 84 in the above-described illustrative embodiment. The contact surface 89 is configured to contact the flap 49 placed in the first state.

The second contact surface 90 extends in the front-rear direction 8 and the left-right direction 9, similar to the first contact surface 89. The first contact surface 89 and the second contact surface 90 are located at positions different from each other in the left-right direction 9. With such structure, a plate member 46 configured to contact the first contact surface 89 and a plate member 46 configured to contact the second contact surface 90 are different from each other. The second contact surface 90 is located above the first contact surface 89. For example, the second contact surface 90 is farther from the platen 42 in the top-bottom direction 7 than the first contact surface 89.

The second contact surface 90 may contact the flap 49 in a following condition. For example, when upward force is further applied to the flap 49 while the flap 49 is in contact with the first contact surface 89, the flap 49 elastically deforms. Due to the elastic deformation of the flap 49, a plate member 46 that is located at a position different from a plate member 46 that is contactable with the first contact surface 89 moves upward. Consequently, the front end portion 37 of the plate member 46 that moves upward contacts the second contact surface 90.

In the above-described modification (in which the contact portion 83 includes the first contact surface 89 and the second contact surface 90), the first contact surface 89 and the second contact surface 90 may support the flap 49 to which external force is applied. Therefore, breakage of the flap 49 due to its significant deformation may be reduced or prevented.

In the above-described illustrative embodiment, two contact portions 83 are provided. Alternatively, one contact portion 83 or three or more contact portions 83 may be provided. For example, contact portions 83 may be located at positions corresponding to all plate members 46. In this case, when the flap 49 is placed in the first state, all plate members 46 contact the respective contact portions 83.

In the above-described illustrative embodiment, the contact surfaces 84 are symmetrical with respect to the center C of a zone in the left-right direction 9 where a recording sheet 12 passes along the first conveying path 65. In another embodiment, the contact surfaces 84 may be provided asymmetrically in the left-right direction 9.

In the above-described illustrative embodiment, the distance R1 in the left-right direction 9 between a pair of adjacent ribs 82 facing each other while sandwiching a contact surface 84 is longer than the distance R2 in the left-right direction 9 between another pair of adjacent ribs 82 facing each other without sandwiching a contact surface 84. In another embodiment, the distance R1 may be shorter than or equal to the distance R2.

In the above-described illustrative embodiment, the contact surface 84 and the inclined surface 85 are aligned with each other in the front-rear direction 8. In another embodiment, the contact surface 84 and the inclined surface 85 may be shifted at different positions in the left-right direction 9.

The first upper guide member 35 may not necessarily include the ribs 82. For example, the lower surface of the base portion 81 may be a guide surface configured to guide a recording sheet 12 conveyed along the first conveying path 65. In this case, a plurality of recesses may be formed on the lower surface of the base portion 81 with a space therebetween in the left-right direction 9. One or more contact portions 83 may be located at the respective recesses. The front end portions 37 of the plate members 46 of the flap 49 may be inserted into the respective recesses and one or more front end portions 37 contact the one or more contact portions 83, respectively.

A member configured to urge the flap 49 upward is not limited to the coil spring 86. For example, a rear portion of the flap 49 relative to the protruding portion 48 may be heavier than a front portion of the flap 49, to urge the front portion of the flap 49 upward.

The flap 49 may not necessarily be urged upward. For example, the multi-function device 10 may not necessarily include the coil springs 86. In this case, the flap 49 may be pivotally moved by, for example, a motor (not depicted).

The second conveying path 71 is intended to change sides of a recording sheet 12 facing the recording unit 24. Therefore, the second conveying path 71 is not limited to the structure as depicted in FIG. 2 of the above-described illustrative embodiment, as long as the intended purpose is satisfied.

For example, the second conveying path 71 may extend above the linear path 34 instead of below the linear path 34. In this case, the flap 49 of the above-described illustrative embodiment may be vertically inverted. For example, the flap 49 may be disposed above the first conveying path 65. The flap 49 may be configured to, when placed in the first state, contact a member which define, from below, the first conveying path 65, and configured to pivot upward such that the flap 49 is placed from the first state to the second state.

In the above-described illustrative embodiment, the branch position 101 is located downstream of the recording unit 24 in the conveying direction 15, and the merge position 102 is located upstream of the recording unit 24 in the conveying direction 15. However, the branch position 101 and the merge position 102 are not limited to the above-described positions.

Figure 10:
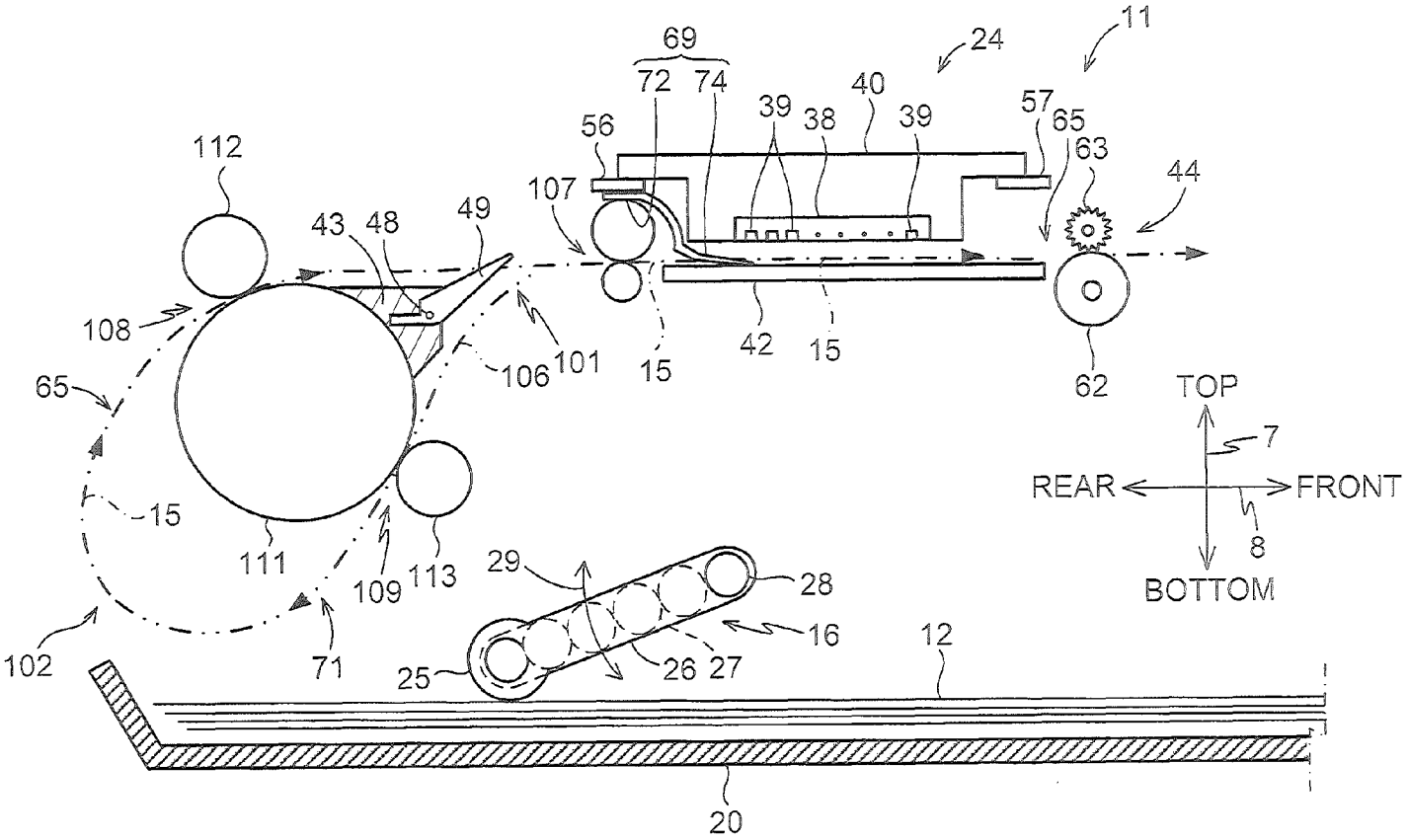
FIG. 10 is a schematic sectional view of a printer section according to a modification of an embodiment, depicting an internal structure thereof.

For example, the branch position 101 and the merge position 102 may be located as depicted in FIG. 10. In a structure as depicted in FIG. 10, the branch position 101 and the merge position 102 are located in the first conveying path 65 at a position upstream of the recording unit 24 in the conveying direction 15. The merge position 102 is located in the first conveying path 65 at a position upstream of the branch position 101 in the conveying direction 15. The flap 49 is pivotally supported at the branch position 101 by a guide member 43. A first roller pair 107 is disposed in the first conveying path 65 at a position between the flap 49 and the recording unit 24. A second roller pair 108 is disposed in the first conveying path 65 at a position upstream of the flap 49 in the conveying direction 15. A third roller pair 109 may be disposed in the second conveying path 71. The second roller pair 108 includes an intermediate roller 111 and a first follower roller 112. The third roller pair 109 includes the intermediate roller 111 that the second roller pair 108 includes, and a second follower roller 113.

The multi-function device 10 may have a function to record an image on a surface of a recording medium which is thicker than a recording sheet 12. In this case, at least one of two members that define the linear path 34 and face each other (e.g., the conveying roller 60 and the pinch rollers 61; the recording unit 24 and the platen 42; the first upper guide member 35 and the platen 42; the spurs 63 and the discharge roller 62; the first upper guide member 35 and the flap 49; and the spurs 68 and the switchback roller 67) moves up and down. Thus, the distance between the two members that define the linear path 34 may be properly changed for image recording on a recording sheet 12 and on a thicker recording medium.

In the above-described illustrative embodiment, the sheet conveying device is configured to convey a recording sheet 12 having an image that is recorded by the recording unit 24. However, a sheet conveying device according to the disclosure is not limited thereto. For example, the disclosure may be applied to a sheet conveying device configured to convey a sheet having an image that is read by a scanner.

What is claimed is:

1. A sheet conveying device comprising:

a housing in which a sheet is conveyed along a first conveying path in a conveying direction and is returned along a second conveying path to the first conveying path;

a first path-defining member;

a second path-defining member facing the first path-defining member in a facing direction to define a portion of the first conveying path; and a flap configured to pivot between a first state in which the flap is in contact with the first path-defining member and guides toward the second conveying path the sheet conveyed in a direction opposite to the conveying direction, and a second state in which the flap is separated from the first path-defining member, wherein the second conveying path is branched off from the first conveying path in a direction away from the first path-defining member, wherein the first path-defining member includes:

a guide surface configured to guide the sheet conveyed along the first conveying path;

a contact surface positioned farther from the second path-defining member in the facing direction than the guide surface, and configured to contact the flap in the first state; and an inclined surface positioned downstream of the contact surface in the conveying direction and inclined such that an upstream end of the inclined surface in the conveying direction is closer to the second path-defining member in the facing direction than a downstream end of the inclined surface in the conveying direction, the upstream end of the inclined surface being closer to the second path-defining member in the facing direction than the contact surface.

2. The sheet conveying device according to claim 1, wherein the first path-defining member includes a plurality of ribs spaced apart from each other in a width direction orthogonal to the conveying direction, the plurality of ribs each protruding toward the second path-defining member and extending along the conveying direction, the guide surface being defined by a plane containing protruding ends of the plurality of ribs, and a pair of ribs adjacent to each other in the width direction among the plurality of ribs sandwiching the contact surface.

3. The sheet conveying device according to claim 1, wherein the contact surface is located at each of two positions which are symmetrical in the width direction with respect to a center of a zone through which the sheet passes along the first conveying path.

4. The sheet conveying device according to claim 2, wherein a distance in the width direction between the pair of ribs adjacent to each other while sandwiching the contact surface is longer than a distance in the width direction between another pair of ribs adjacent to each other without sandwiching the contact surface.

5. The sheet conveying device according to claim 2, wherein the contact surface includes:

a first contact surface configured to contact the flap in the first state; and a second contact surface located farther from the second path-defining member in the facing direction than the first contact surface and configured to contact the flap when the flap elastically deforms further from the first state.

6. The sheet conveying device according to claim 1, further comprising an urging member configured to urge the flap into the first state.

7. The sheet conveying device according to claim 1, further comprising a switchback roller disposed downstream, in the conveying direction, of a conjunction of the first conveying path and the second conveying path, the switchback roller being configured to rotate forwardly to convey the sheet in the conveying direction along the first conveying path and configured to rotate reversely, wherein the flap in the first state guides toward the second conveying path the sheet conveyed by the switchback roller rotating reversely.

8. The sheet conveying device according to claim 1, wherein the flap is pivotably supported by the second path-defining member.

9. The sheet conveying device according to claim 1, wherein the flap in the second state is separated from the first path-defining member by being contacted by the sheet conveyed in the conveying direction.

10. A sheet conveying device comprising:

an upper guide member;

a flap disposed facing the upper guide member to define a portion of a first conveying path, the flap being configured to pivot between a first state in which an upper end of the flap is in contact with the upper guide member, and a second state in which the upper end of the flap is spaced from the upper guide member;

a roller disposed in the first conveying path at a position downstream of the flap in a conveying direction and configured to rotate forwardly to convey a sheet along the first conveying path in the conveying direction and configured to rotate reversely to convey the sheet in a direction opposite to the conveying direction toward a second conveying path;

wherein the upper guide member includes:

a guide surface configured to guide the sheet conveyed along the first conveying path;

a contact surface positioned above the guide surface and configured to contact the upper end of the flap in the first state; and an inclined surface positioned downstream of the contact surface in the conveying direction and inclined such that an upstream end of the inclined surface in the conveying direction is lower than a downstream end of the inclined surface in the conveying direction, the upstream end of the inclined surface being lower than the contact surface.

11. The sheet conveying device according to claim 10, wherein the inclined surface of the upper guide member is configured to receive the sheet conveyed by the roller rotating reversely, and the flap is configured to, when in the first state, guide toward the second conveying path the sheet conveyed by the roller rotating reversely.

12. The sheet conveying device according to claim 10 wherein the upper guide member includes a plurality of ribs spaced apart from each other in a width direction orthogonal to the conveying direction and protruding downward, lower ends of the plurality of ribs serving as the guide surface, and a pair of ribs adjacent to each other in the width direction among the plurality of ribs sandwiching the contact surface and the inclined surface.

13. An image recording apparatus comprising:

a recording unit configured to record an image on a sheet conveyed along a first conveying path; and a sheet conveying device comprising:

a housing in which the sheet is conveyed along the first conveying path in a conveying direction and is returned along a second conveying path to the first conveying path;

a first path-defining member;

a second path-defining member facing the first path-defining member in a facing direction to define a portion of the first conveying path; and a flap configured to pivot between a first state in which the flap is in contact with the first path-defining member and guides toward the second conveying path the sheet conveyed in a direction opposite to the conveying direction, and a second state in which the flap is separated from the first path-defining member, wherein the second conveying path is branched off from the first conveying path in a direction away from the first path-defining member, wherein the first path-defining member includes:

a guide surface configured to guide the sheet conveyed along the first conveying path;

a contact surface positioned farther from the second path-defining member in the facing direction than the guide surface, and configured to contact the flap in the first state; and an inclined surface positioned downstream of the contact surface in the conveying direction and inclined such that an upstream end of the inclined surface in the conveying direction is closer to the second path-defining member in the facing direction than a downstream end of the inclined surface in the conveying direction, the upstream end of the inclined surface being closer to the second path-defining member in the facing direction than the contact surface.

14. The image recording apparatus according to claim 13 wherein the second conveying path is branched off from the first conveying path at a branch position downstream of the recording unit in the conveying direction, and merges with the first conveying path at a merge position upstream of the recording unit in the conveying direction, the flap being disposed at the branch position.

15. The image recording apparatus according to claim 14 further comprising a conveying roller disposed between the merge position and the recording unit in the conveying direction and configured to rotate forwardly to convey the sheet in the conveying direction.

16. The image recording apparatus according to claim 15 further comprising a discharge roller disposed between the recording unit and the branch position in the conveying direction and configured to rotate forwardly to discharge the sheet in the conveying direction.

17. The image recording apparatus according to claim 13 further comprising a corrugation mechanism configured to corrugate the sheet conveyed along the first conveying path.

18. The image recording apparatus according to any one of claims 13, wherein the flap in the second state is separated from the first path-defining member by being contacted by the sheet conveyed in the conveying direction.

* * * * *